United States Patent [19]

Nguyen

[11] Patent Number: 4,500,156

[45] Date of Patent: Feb. 19, 1985

[54] ELECTRICAL CONNECTOR

[75] Inventor: Khoi B. Nguyen, Sugar Land, Tex.

[73] Assignee: Schlumberger Technology Corporation, Houston, Tex.

[21] Appl. No.: 471,416

[22] Filed: Mar. 2, 1983

[51] Int. Cl.[3] ..... H01R 13/523

[52] U.S. Cl. ..... 339/94 C; 339/116 C; 339/117 R

[58] Field of Search ..... 339/94 R, 94 C, 42, 339/115 C, 116 C, 117 R, 94 M, 96, 15, 16 R, 16 C, 117 P

[56] References Cited

U.S. PATENT DOCUMENTS

| | | | |
|---|---|---|---|
| 3,277,424 | 10/1966 | Nelson | 339/94 |
| 3,412,365 | 11/1968 | Nelson | 339/60 |
| 3,478,297 | 11/1969 | Gimpel et al. | 339/60 |
| 3,478,298 | 11/1969 | Nelson | 339/61 |
| 3,508,188 | 4/1970 | Buck | 339/42 |
| 3,729,699 | 4/1973 | Briggs et al. | 339/42 |
| 3,821,690 | 6/1974 | Small | 339/75 R |
| 3,845,450 | 10/1974 | Cole et al. | 339/42 |
| 4,039,242 | 8/1977 | Wilson et al. | 339/177 E |
| 4,299,431 | 11/1981 | Wilson et al. | 339/60 R |

*Primary Examiner*—Eugene F. Desmond
*Assistant Examiner*—Steven C. Bishop

[57] ABSTRACT

An electrical connector adapted for making and/or breaking an electrical connection in a fluid environment, having two mateable members forming the electrical connection within an internal receptacle which although open to external environment prior to mating, can be sealed from the external environment as part of the mating process. The connectors includes a passageway leading from the receptacle to the external environment through which any fluids within the receptacle can be expelled as the connection is being made. This passageway is interrupted during the mating process.

12 Claims, 2 Drawing Figures

ELECTRICAL CONNECTOR

BACKGROUND OF THE INVENTION

This invention relates to an electrical connector which is capable of being connected in an environment potentially occupied by fluids and/or gases, such as is found within a borehole.

It is very often desirable to establish an electrical connection within an environment such as that present within a borehole. This type of environment, however, usually involves high pressures and temperatures and a combination of fluids, solids and gases as inhabitants, which make the downhole electrical connection very difficult and complex. The existing electrical connectors that have been developed for fluid environments in general, typically utilize a two-part mateable connector, i.e. a male member and a female member with the female member including a receptacle which is adapted to closely receive a portion of the male member. Both the female member and the male member contain one or more electrically conductive elements thereon which establish electrical contact with each other when the male member is inserted into the female member. To enable this connector to operate within a fluid environment a complex arrangement of plungers and pistons is generally used to evacuate the fluid contents of the receptacle, or a dielectric oil is contained within the receptacle to ensure electrical isolation even in the presence of an invading fluid, or the connector uses some combination of the above. The complex configurations which result are generally expensive to manufacture and typically prone to failure.

Any use of such general fluid environment connectors in a borehole environment introduces even further difficulties because of the extreme pressure and temperature conditions which are present within the borehole.

SUMMARY OF THE INVENTION

In view of the aforementioned shortcomings of the connectors described above, the improved connector of the present invention has been designed with a simplified structure that can be utilized to achieve electrical connection in a downhole environment in spite of the severe pressure and temperature conditions found there.

The electrical connector of the present invention comprises two members adapted for mating, i.e. one of the members includes receptacle means for closely receiving at least a part of the other member and the other member includes a projection adapted for insertion within the receptacle means. One of the members also includes a passageway which is in communication with the receptacle means and which affords an egress from the receptacle means through which any fluids within the receptacle means can be displaced as the members are mated. A housing supports one of these members and contains another passageway which is in communication with an environment exterior to the connector and which affords an egress to this exterior environment through which any displaced fluids can be evacuated. Resilient means are interposed between the housing and the member supported by the housing. These resilient means are adapted for closely receiving at least part of the other member, and for sealing the outer periphery of the members from the exterior environment when these members are mated. The resilient means include a third passageway which is in communication with the first passageway and therefore ultimately in communication with the receptacle means. The member supported by the housing is mounted within the housing for movement from a first position where all the passageways are in communication, to a second position where the passageway within the housing and the passageway leading from the receptacle means are not in communication and where the resilient means seal the receptacle means and the electrically conductive elements mated together therein from the exterior environment. The member supported by the housing is normally biased within the housing to the first position affording the egress from the receptacle means to the exterior environment. Any fluids within the receptacle means are therefore displaced through the first, second and third passageways to the exterior environment as the members of the connector are mated. Continued application of a force on the members in the direction of mating and in excess of the force being exerted by the biasing means, affords the movement of the supported member to the second position where the receptacle means and the electrically conductive elements therein are effectively sealed from the exterior environment.

This connector of the present invention therefore evacuates the receptacle in which electrical contact is to be established as the members are being mated and then effectively seals the electrically conductive elements therein from the exterior environment. A connection or disconnection of the connector of the present invention is therefore possible within the extremely hostile environment that is present within the borehole. These advantages of the present invention will be apparent from the detailed description which follows.

BRIEF DESCRIPTION OF THE DRAWING

The present invention will be further described hereinafter with reference to the accompanying drawing wherein.

DETAILED DESCRIPTION

Figure 1:
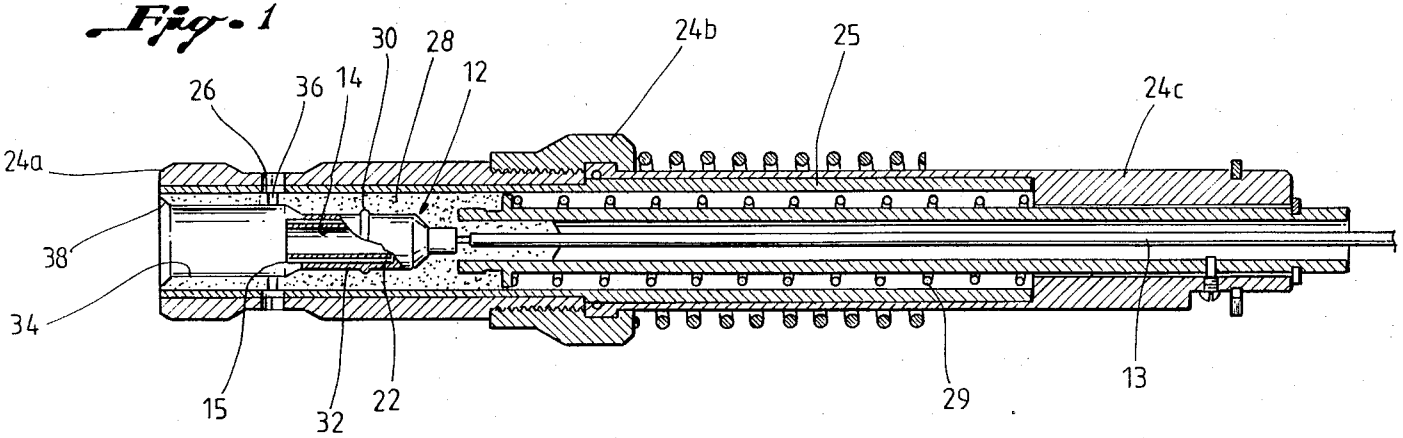
FIG. 1 is a longitudinal sectional view of one of the members of the connector according to the present invention.

A first member 12 of the connector 10 according to the present invention is illustrated in FIG. 1. This member 12 would typically be referred to as the female member because it contains a receptacle 14 which is adapted for closely receiving at least a part of the male member 16 (see FIG. 2) of the connector 10. Typically the receptacle 14 of the female member 12 is machined or molded within a solid electrical conductor. Electrically conductive elements could however also be fixed within a receptacle 14 of a female member 12 formed from a non-conductive material. These elements of the member 12 are connected with an appropriate lead 13 to the circuitry with which electrical contact is to be established. For example, the female member 12 of the preferred embodiment is connected to a wireline (not shown) on which this member 12 is lowered into a borehole. Lead 13 is part of this wireline and provides the electrical connection between the female member 12 and the control circuitry that is typically located uphole. Appropriate sealing means 28 are used to seal the entrance of lead 13 into the female member 12.

The corresponding male member 16 is typically part of the sonde or other device (not shown) being used within the borehole to perform measurements on the formations adjacent the borehole. Appropriate electrical connections (not shown) are made between the sonde and the male member 16. The male member 16 has a longitudinal projection 18 thereon which is adapted to be received within the receptacle 14 of member 12 as it is lowered onto the sonde or other device. This projection 18 has one or more electrically conductive elements 20 attached thereto. In the preferred embodiment the male member 16 is very similar to a standard banana plug configuration in which the elements 20 are biased radially outward from the projection 18 to have a greater cross-sectional diameter than the inner diameter of the receptacle 14. Upon insertion of the male member 16 within the female member 12, these elements 20 are compressed thereby ensuring electrical contact with the receptacle 14.

In the preferred embodiment the female member 12 includes a passageway 22 which is in communication with the rear portion of the receptacle 14 and which terminates exterior to the receptacle 14 and adjacent the front opening 15 of the receptacle 14. This passageway 22 affords an egress from the receptacle 14 through which any fluids that might be within the receptacle 14 can be displaced as the members 12 and 16 are mated. It should be mentioned that the passageway described within the female member 12 could also be located within the male member 16 and still function as described.

In the preferred embodiment the female member 12 is supported within a housing 24. To facilitate the assembly of the female member 12 the housing 24 is made up of three separable components 24*a*, 24*b*, and 24*c* which can be joined together in a conventional manner. Alternatively, the male member 16 could also be the supported member. A teflon sleeve 25 is interposed between the housing 24 and the female member 12. This sleeve 25 has two functions, first to electrically insulate certain components of the connector 10 from the exterior environment which may be electrically conductive and secondly to facilitate the sealing action of the connector 10 as will be described. The housing 24 and sleeve 25 include a passageway 26 which is in communication with an environment exterior to the receptacle 14 and which can provide an egress to such exterior environment for any fluids which are displaced from the receptacle 14.

In order to ensure that the borehole fluids cannot invade the receptacle 14 once the members 12 and 16 are mated, eg. by passing between the sleeve 25 and the female member 12 supported therein, a resilient gasket 28 is interposed within the sleeve 25 and between the housing 24 and the female member 12. This resilient gasket or seal 28 is affixed to the female member 12 by the interaction between an annular projection 30 located around the periphery of the female member 12 and a corresponding annular recess 32 located within the resilient seal 28. This resilient seal 28 is closely fitted between the female member 12 and the sleeve 25 in order to seal the female member 12 from the exterior environment. The resilient member 28 also contains a chamber 34 which is adjacent the opening 15 of the female member 12 and therefore in communication with the receptacle 14. The passageway 22 within the female member 12 exits within this chamber 34. The front opening 38 leading into the chamber 34 is adjacent the front end of the resilient seal 28. Also in communication with chamber 34 is a third passageway 36 formed within the resilient seal 28. The female member 12 and the attached resilient seal 28 are normally positioned within the housing 24 such that communication is afforded between the passageways 26 and 36, as well as passageway 22 which also opens into the chamber 34. A spring 29 is positioned within the sleeve 25 between the seal 28 and the housing 24 to bias the female member 12 at this first position. The female member 12, and the resilient seal 28 are however moveable within the housing 24 such that an application of force on the connector 10 in the direction of the mating can overcome the biasing force of the spring 29 and move the female member 12 to a second position within the housing 24 where the passageway 36 within the resilient seal 28 is displaced from the passageway 26 within the housing 24. At this second position the resilient seal 28 effectively seals off all access to the receptacle 14 except through the frontal opening 38 within the resilient seal 28. A conventional releasable latching mechanism (not shown) can be utilized to keep the female member 12 at this second position within the connector 10.

Figure 2:
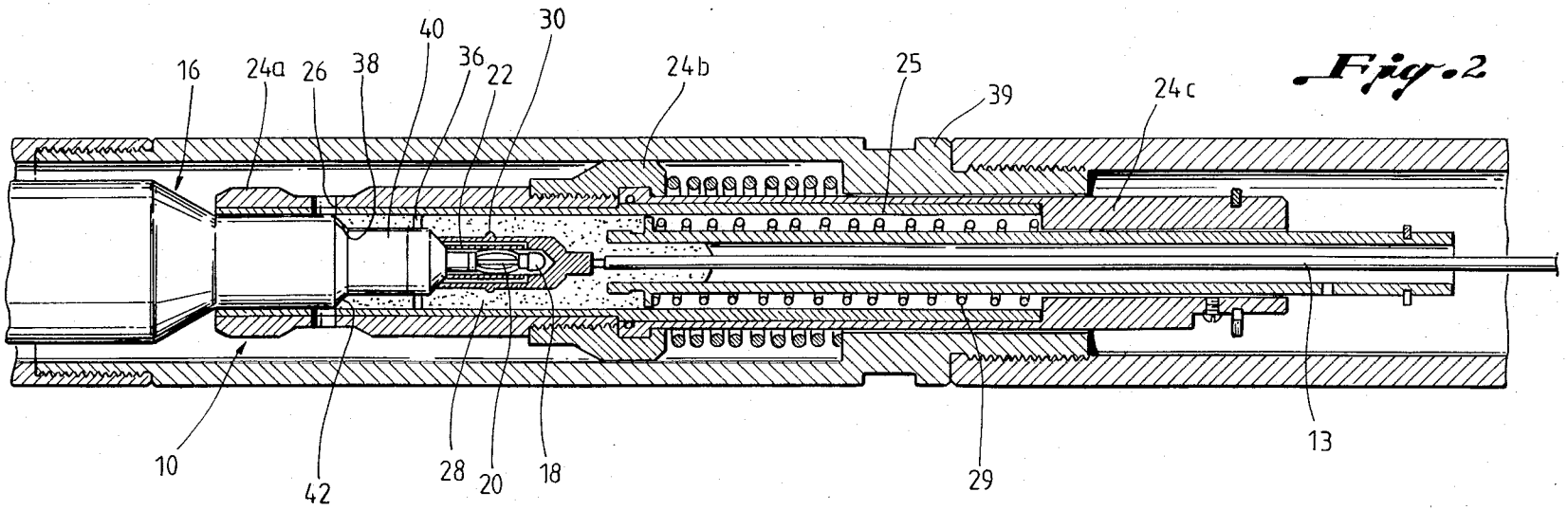
FIG. 2 is a partial longitudinal sectional view of both of the members of the connector according to the present invention with the members mated to establish electrical contact.

Looking now at FIG. 2, the female member 12 is shown mounted within a section of tubing 39. This tubing 39 is used to further support and protect the member 12 as it is being lowered into the borehole. Also illustrated is the male member 16 which in addition to the projection 18 and electrical contacts 20 includes a plunger 40 and an annular sealing flange 42. This plunger 40 and flange 42 are adapted to cooperate with the resilient seal 28 in sealing the conductive elements 20 from the exterior environment when the members 12 and 16 of the connector 10 are mated. As has already been discussed, the female member 12 is typically attached to a wireline on which it can be lowered into the borehole. The male member 16 is caused to enter the chamber 34. As the female member 12 begins to envelop the male member 16 the longitudinal projection 18 begins to displace any fluid that might be located within the receptacle 14. This fluid is displaced through the first passageway 22 and into the chamber 34 defined by the chamber 34, through the passageway 36 within the resilient seal 28. Since the female member 12 and the resilient seal 28 are initially positioned within the housing 24 such that the passageway 36 is in communication with the passageway 26 and therefore the environment exterior to the connector 10, any fluids within the chamber 34 will be expelled to the exterior environment. When the projection 18 is fully inserted within the female member 12 the annular flange 42 will be in contact with the frontal opening 38 of the resilient seal 28. This frontal opening 38 and the flange 42 are also dimensioned and shaped to ensure a sealed and closely fitting relationshp between the housing 24, the resilient seal 28 and the male member 16. The continued application of force on the members 12 and 16 in the direction of mating moves the female member 12 to its second position where the passageway 26 within the resilient seal 28 is spaced from the passageway 36 within the housing 24. As this happens any path along which fluid could flow is interruped with the resilient seal 28 effectively sealing the conductive elements 20 from the exterior environment. Additionally the relative movement between the tightly fitting resilient seal 28 and the sleeve 25 results in a progressive squeezing or milking action on the seal 28 within the portion of the seal 28 in which the members 12 and 16 are mated. This squeezing action further ensures the evacuation of all fluids within the chamber 34, and therefore the integrity of the electrical connection. Typically the members 12 and 16 are latched at this second position thus ensuring that the respective members are mated together to establish the electrical connection. Numerous releasable latching mechanisms are commercially available and thus will not be described herein.

It is important to mention that this connector 10 can be connected and disconnected in the high pressure conditions present within the downhole environment. This is because the connector is effectively open to the downhole pressure as the connection is made. There are also no chambers containing dielectric or other fluids at atmospheric pressures which must be emptied out against the downhole pressure in order for the connection to be made. Hence this downhole pressure, which is typically several times greater than atmospheric pressure, need not be overcome in order to make the electrical connection.

Having thus described the connector 10 of the present invention it will be understood that changes may be made in the size, shape or configuration of some of the parts of the connector 10 described herein without departing from the present invention as recited in the appended claims. In particular the operative structure of the connector 10, such as the various passageways could alternatively be formed within the male member 16 instead of, or in addition to the female member 12 without affecting the overall performance.

I claim:

1. An electrical connector suitable for use in an underwater environment comprising:

a first and second member each having one or more electrically conductive elements thereon which members are adapted to mate with each other and thereby establish electrical contact between said conductive elements, said second member including a receptacle for closely receiving at least part of the other member and said part of said other member being adapted for insertion within said receptacle, a housing for supporting said second member, means, within wall portions of said housing, defining a passageway in communication with said receptacle for affording egress to an environment exterior to said receptacle for any fluids within said receptacle which are displaced during the mating of said members, and means for interrupting said means for affording egress after said members have been mated and for sealing said receptacle from the exterior environment comprising:

resilient means affixed between said housing and said second member supported by said housing, for closely receiving at least part of said other member, and for sealing the outer periphery of said members from the exterior environment when said members are mated, means for mounting said member being supported by said housing in said housing affording the movement of said member from a first position where said egress means provides communication with the exterior environment and said receptacle to a second position where said egress means is interrupted, and biasing means axially aligned with said receptacle means and positioned between said housing and said member being supported by said housing, for biasing said supported member at said first position to afford an egress from said receptacle to the exterior environment through which, any fluids within said receptacle means can be displaced to the exterior environment, and whereby the continued application of a force on said members in the direction of mating in excess of the force being exerted by said biasing means affords the movement of said supported member to said second position thereby sealing said receptacle means from the exterior environment.

2. A connector as claimed in claim 1 wherein said means for affording egress includes wall portions within said resilient means defining a passageway.

3. An electrical connector as claimed in claim 1 wherein said member adapted for insertion further comprises wall portions substantially defining a plunger, and said resilient means further comprises wall portions defining a chamber in communication with said receptacle and said passageway and having a front opening leading therein, said chamber being adapted to closely receive said plunger, whereby the insertion of said projection within said receptacle means will afford the entrance of said plunger within said chamber through said frontal opening and whereby the continued insertion of said member adapted for insertion will afford the expulsion of any fluids from said chamber and said receptacle through said passageway, and wherein said connector further comprises an annular flange adapted to cooperate with said resilient means to seal said frontal opening.

4. An electrical connector suitable for use in an underwater environment comprising:

a first and a second member each having one or more electrically conductive elements thereon which members are adapted to mate with each other and thereby establish electrical contact between said conductive elements, one of said members including receptacle means for closely receiving at least part of the other member and said part of said other member being adapted for insertion within said receptacle means, and wherein one of said members includes wall portions defining a first through-passageway in communication with said receptacle means, a housing for supporting one of said members, said housing including wall portions defining a second through-passageway providing egress to an environment exterior to the connector, resilient means affixed between said housing and said member supported by said housing, for closely receiving at least part of said other member, and for sealing the outer periphery of said members from the exterior environment when said members are mated, said resilient means including wall portions defining a third through-passageway which is in communication with said first through-passageway, means for mounting said member being supported by said housing in said housing affording the movement of said member from a first position where said passageways are in communication to a second position where said third passageway and said second passageway are not in communication and where said resilient means affords the sealing of said receptacle means and said conductive elements therein from the exterior environment, biasing means axially aligned with said receptacle means and positioned between said housing and said member being supported by said housing, for biasing said supported member at said first position to afford an egress from said receptacle means to the exterior environment, through which any fluids within said receptacle means can be displaced to the exterior environment, and whereby the continued application of a force on said members in the direction of mating in excess of the force being exerted by said biasing means affords the movement of said supported member to said second position thereby sealing said receptacle means from the exterior environment.

5. An electrical connector as claimed in claim 4 wherein said second member includes said first through-passageway.

6. An electrical connector as claimed in claim 4 wherein said first member includes a generally longitudinal projection adapted for insertion within said receptacle means having said electrically conductive elements thereon, and said second member includes said receptacle means and one or more electrically conductive elements within said receptacle means.

7. An electrical connector as claimed in claim 6 further comprising biasing means for biasing said electrically conductive elements radially outward from said longitudinal projection to ensure the electrical contact between said electrically conductive elements on said projection and said electrically conductive elements within said receptacle means.

8. An electrical connector as claimed in claim 7 wherein said second member includes said first through-passageway.

9. An electrical connector as claimed in claim 8 wherein said second member is substantially formed with an electrically conductive material.

10. An electrical connector as claimed in claim 9 wherein said second member further comprises an annular projection extending from the periphery thereof, and said resilient means includes an annular recess adapted to receive said annular projection of said member and thereby affix said resilient means to said second member.

11. An electrical connector as claimed in claim 10 wherein said first member further comprises wall portions substantially defining a plunger, and said resilient means further comprises wall portions defining a chamber in communication with said receptacle means and said first and third through-passageways and having a frontal opening leading therein, said chamber being adapted to closely receive said plunger, whereby the insertion of said projection within said receptacle means will afford the entrance of said plunger within said chamber through said frontal opening and whereby the continued insertion of said first member will afford the expulsion of any fluids from said chamber and said receptacle means through said first and third passageways.

12. An electrical connector as claimed in claim 11 wherein said first member further comprises an annular flange adapted to cooperate with said resilient means to seal said frontal opening.

* * * * *